United States Patent [19]

Johnson

[11] Patent Number: 5,067,618

[45] Date of Patent: Nov. 26, 1991

[54] LAUNDRY ORGANIZER APPARATUS

[76] Inventor: Leinani Johnson, 627 Anela Pl., Wailuku, Hi. 96793

[21] Appl. No.: 619,603

[22] Filed: Nov. 29, 1990

[51] Int. Cl.[5] ..... A47F 7/00

[52] U.S. Cl. ..... 211/13; 24/303; 224/901; 248/206.5

[58] Field of Search ..... 211/13, DIG. 1; 248/206.5; 224/901, 42.45 A, 42.46 A, 268; 24/DIG. 28, DIG. 29, 303

[56] References Cited

U.S. PATENT DOCUMENTS

| | | | |
|---|---|---|---|
| 1,716,052 | 6/1929 | Hagel | 24/DIG. 28 |
| 2,580,099 | 12/1951 | Jaeger | 248/206.5 X |
| 2,625,724 | 1/1953 | Sampson | 24/303 |
| 2,693,654 | 11/1954 | Clark | 24/303 |
| 2,955,239 | 10/1960 | Rouse | 211/DIG. 1 |
| 2,977,082 | 3/1961 | Harris | 248/206.5 |
| 3,174,714 | 3/1965 | Bradsby | 24/303 X |
| 3,374,508 | 3/1968 | Slimovitz | 224/901 X |
| 3,518,884 | 7/1970 | Wood, Jr. | 248/206.5 X |
| 4,151,938 | 5/1979 | Barker et al. | 224/268 X |

FOREIGN PATENT DOCUMENTS

| | | | |
|---|---|---|---|
| 0298232 | 7/1932 | Italy | 24/303 |

*Primary Examiner*—Carl D. Friedman
*Assistant Examiner*—Daniel Hulseberg
*Attorney, Agent, or Firm*—Leon Gilden

[57] ABSTRACT

An apparatus including a flexible support plate member formed of memory retentent material, including a serpentine arcuate exterior continous surface formed with a series of equally spaced apertures formed through the plate member adjacent the surface. The plate member further includes a series of securement fasteners, with a securement fastener directed through each aperture for securement of various clothing garments thereto to secure and arrange the garments in an orderly array during a laundry procedure.

1 Claim, 4 Drawing Sheets

PRIOR ART 10
11
12
13
14
15
16
17
18
*Baby*

LAUNDRY ORGANIZER APPARATUS

BACKGROUND OF THE INVENTION

1. Field of the Invention

The field of invention relates to laundry apparatus, and more particularly pertains to a new and improved laundry organizer apparatus wherein the same permits selective securement and maintaining of various laundry garments in orderly array during a laundry procedure.

2. Description of the Prior Art

During various laundry procedures, such as washing and drying, garment members such as sock pairs and the like are frequently misplaced within a laundry array. The instant invention attempts to overcome deficiencies of the prior art by providing a convenient and orderly organizer arrangement to secure and permit agitation of the secured garments during laundry.

Examples of the prior art include U.S. Pat. No. 3,972,094 to Fuller wherein a housing structure includes a plurality of clips for securement of garments such as socks within the housing U.S. Pat. No. 4,682,389 to Callender sets forth a garment connector formed of male and female elements to temporarily secure garments together.

U.S. Pat. No. 4,058,853 to Boxer, et al. sets forth socks with flexible self-contained fastener patches to secure the socks together during a laundry procedure.

U.S. Pat. No. 2,779,076 to Schenck, Sr. sets forth a clasping fastener is arranged to secure sock pairs for mounting the sock pairs in laundering.

U.S. Pat. No. 4,503,591 to Adamska-koperska sets forth a ring member for storing articles of clothing, with a point end for insertion of the ring through various articles of clothing during laundry. As noted, the organization fails to provide separate fasteners to segregate the articles for convenience of separations prior to and subsequent to a laundry procedure.

As such, it may be appreciated that there continues to be a need for a new and improved laundry organizer apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of laundry organizer apparatus now present in the prior art, the present invention provides a laundry organizer apparatus wherein the same permits discrete securement and positioning of various garment members in an orderly array during a laundry procedure. As such, the general purpose of the present invention, which will be described subsequently in greater detail, is to provide a new and improved laundry organizer apparatus Which has all the advantages of the prior art laundry organizer apparatus and none of the disadvantages.

To attain this, the present invention provides an apparatus including a flexible support plate member formed of memory retentent material, including a serpentine arcuate exterior continuous surface formed with a series of equally spaced apertures formed through the plate member adjacent the surface. The plate member further includes a series of securement fasteners, with a securement fastener directed through each aperture for securement of various clothing garments thereto to secure and arrange the garments in an orderly array during a laundry procedure.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved laundry organizer apparatus which has all the advantages of the prior art laundry organizer apparatus and none of the disadvantages.

It is another object of the present invention to provide a new and improved laundry organizer apparatus which may be easily and efficiently manufactured and marketed.

It is a further object of the present invention to provide a new and improved laundry organizer apparatus which is of a durable and reliable construction.

An even further object of the present invention is to provide a new and improved laundry organizer apparatus which is susceptible of a low cost of manufacture with regard to both materials and labor, and which accordingly is then susceptible of low prices of sale to the consuming public, thereby making such laundry organizer apparatus economically available to the buying public.

Still yet another object of the present invention is to provide a new and improved laundry organizer apparatus which provides in the apparatuses and methods of the prior art some of the advantages thereof, while simultaneously overcoming some of the disadvantages normally associated therewith.

Still another object of the present invention is to provide a new and improved laundry organizer apparatus wherein the same permits securement of selective garments within a mounting plate to permit relative agitation of the garments relative to the plate during a laundry procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
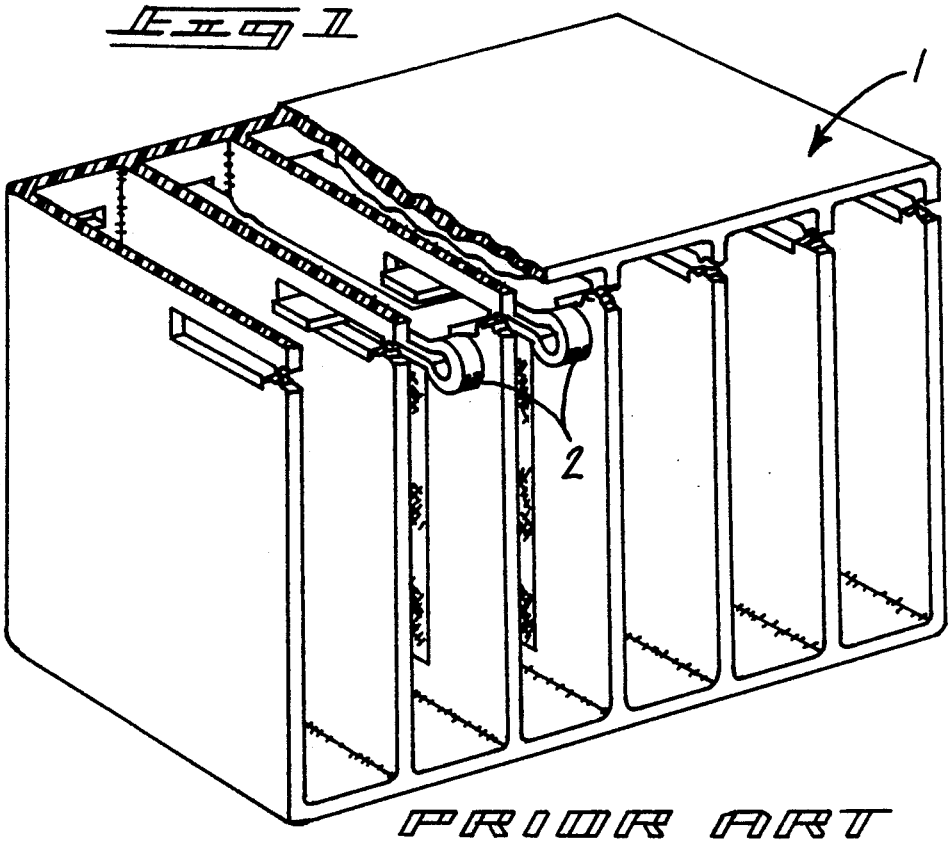
FIG. 1 is an isometric illustration of a prior art laundry organizer apparatus.
Figure 2:
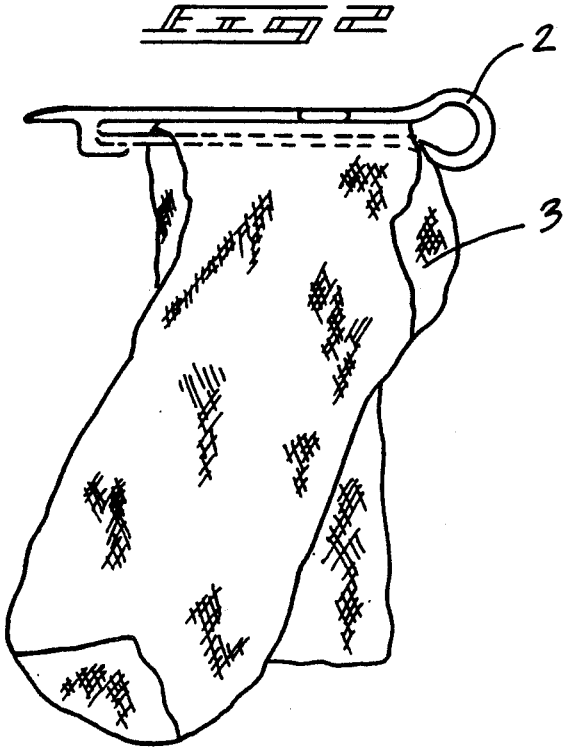
PRIOR ART FIG 2
FIG. 2 is an orthographic side view, taken in elevation, of a clip member utilized in the apparatus as set forth in FIG. 1.

With reference now to the drawings, and in particular to FIGS. 1 to 6 thereof, a new and improved laundry organizer apparatus embodying the principles and concepts of the present invention and generally designated by the reference numeral 10 will be described.

FIG. 1 illustrates a prior art laundry organizer apparatus 1, defining a housing utilizing a plurality of clips 2 mounted within the housing for securement of garment items such as sock pairs 3 within various compartments of the housing, as set forth in U.S. Pat. No. 3,972,094.

Figures 3, 3A:
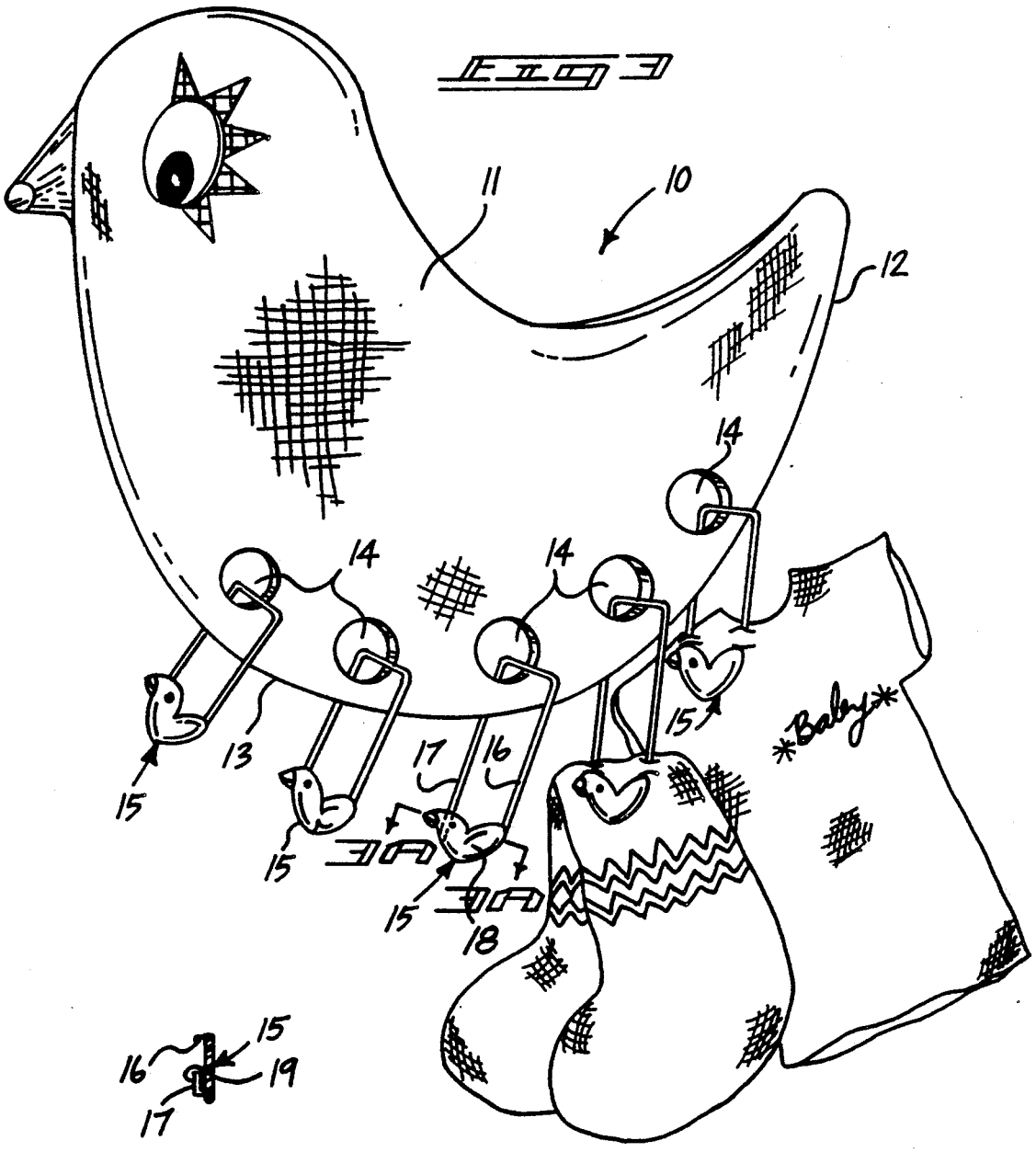
FIG. 3 is an orthographic side view, taken in elevation, of the apparatus of the instant invention.
FIG. 3A is an orthographic side view, taken in elevation, of the securement fastener of the instant invention.

More specifically, the laundry organizer apparatus 10 of the instant invention essentially comprises a flexible, polymeric support plate member 11 defined by a continuous arcuate serpentine perimeter edge 12. The edge 12 is devoid of pointed projections to compromise obstruction with laundry when the organization is positioned within a washer or dryer apparatus utilized typically for laundering procedures. The plate member 11 includes a convex bottom edge portion 13 that includes a series of equally spaced apertures 14 directed through the plate member adjacent the bottom edge portion 13. A securement fastener 15 is pivotally mounted within each aperture. Each securement fastener 15 includes a spring biased clip defined by a first leg 16 and a second leg 17 biased apart relative to one another. The first leg 16 is fixedly secured to a clasp body 18, wherein the clasp body 18 includes an "L" shaped leg 19 projecting therefrom to receive the second leg 17 therewithin. A free terminal end of the second leg 17 includes a pointed projection to permit piercing of various garment portions such as socks when securing the garment portions and positioning them within a laundry organization. Further, the "U" shaped clips defined by the first and second legs 16 and 17 define a first plane, wherein the plate member defines the second plane, with the first plane arranged generally parallel to the second plane to effect repositioning of the garments in a spaced relationship, as illustrated in FIG. 3 for example.

Figure 4:
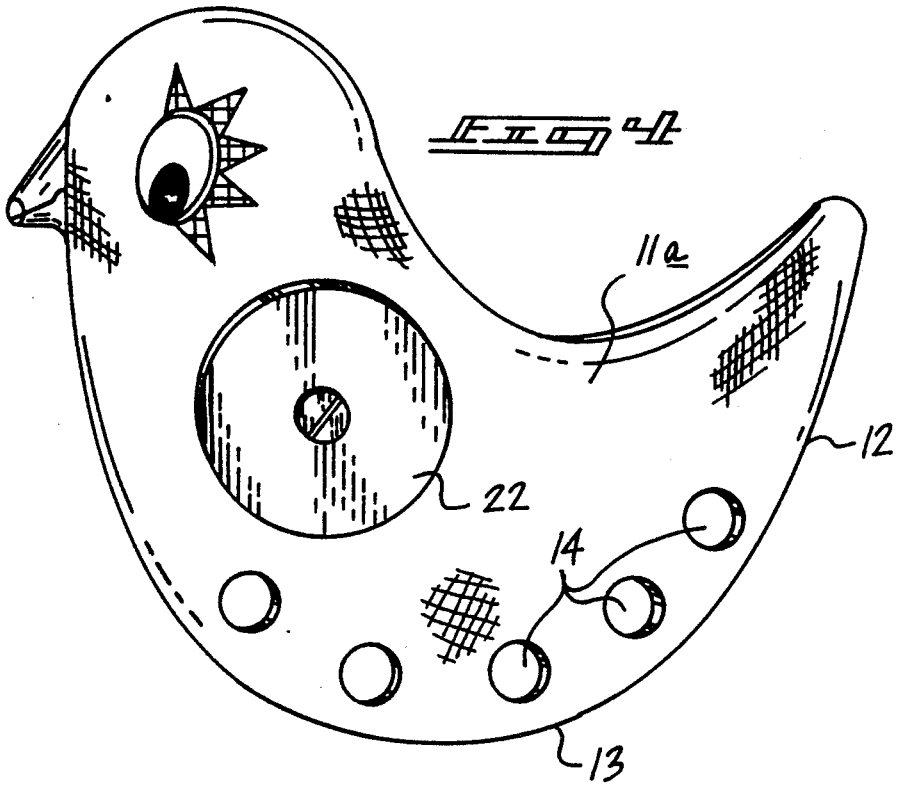
FIG. 4 is an orthographic side view, taken in elevation, of a modified support plate member utilized by the apparatus of the instant invention.
Figure 5:
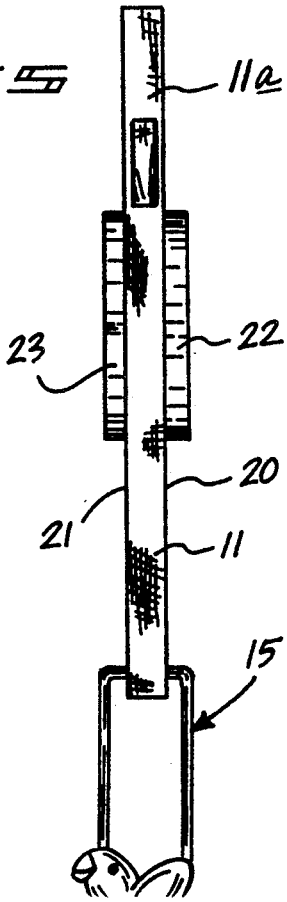
FIG. 5 is an orthographic side view, taken in of the instant invention.
Figure 6:
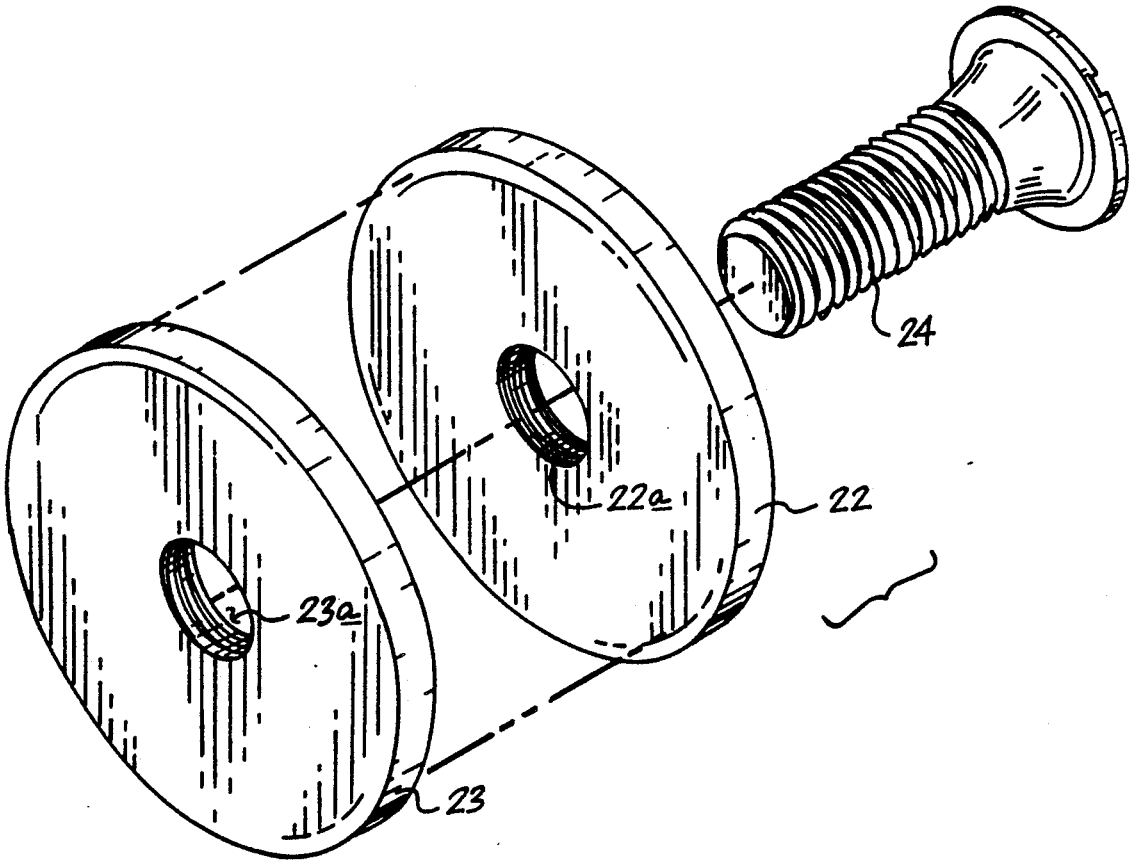
FIG. 6 is an isometric illustration of the fastener organization utilized by the instant invention.

FIGS. 4 and 5 illustrate the use of magnetic members mounted to opposed sides of the plate member to permit securement of the plate member interiorly of a washing drum, such as in a conventional clothes washer or dryer, to minimize rattling and damage to the drum during use while the clothing garments are suspended from the various securement fasteners 15 permitting the agitation required for effecting cleaning of the garments. The magnetic devices include a first arcuate cylindrical magnetic member 22 mounted to a first plate side 20 of the plate member 11, with a second arcuate cylindrical magnetic member 23 mounted to the second plate side 21, with the first and second magnetic members coaxially aligned relative to one another, including a threaded fastener 24 directed coaxially therethrough. The arcuate configuration of the magnetic members minimize engagement of the members with various other garments of clothing within a washing environment, such as in a clothes washer or dryer. The first magnetic member 22 includes a first smooth central bore **22*a* with the second magnetic member including a threaded bore 23*a*. The first magnetic member 22 is defined by a predetermined first width, wherein the second magnetic member 23 is defined by a second width. The plate member 11 or 11*a* as modified is defined by a predetermined plate width, wherein the threaded fastener 24 is directed through the bore 22*a*, through the plate member 11*a*, and then into the second magnetic member 23 and is of a predetermined length substantially equal to the total of the first predetermined width, the second predetermined width, and the plate width to assure that the fastener is wholly contained within the magnetic members and the plate during assembly of the organization. Further, it is desired that the first bore 23*a*** includes a counter-bore to receive a head portion of the threaded fastener to assure the threaded fastener is contained within the organization and provide no projection of various portions thereof interiorly of the apparatus in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A laundry organizer apparatus comprising, a flexible support plate member, the plate member defined by a continuous arcuate perimeter edge, the perimeter edge including a bottom edge portion, and a bottom edge portion including a series of equally spaced apertures directed through the support plate member adjacent the bottom edge portion, and each of the apertures includes a securement fastener pivotally mounted thereon, and wherein each securement fastener includes a "U" shaped clip, the "U" shaped clip including a first leg mounted to and arranged in a spaced relationship to a second leg, the second leg spring biased relative to the first leg, each securement fastener further including a clasp body, the clasp body mounted to the first leg, with the second leg selectively securable to the clasp body to define a continuous loop, wherein the first and second leg define a first plane, and the support plate defines a second plane, wherein the first plane is arranged generally orthogonally relative to the second plane, and wherein the plate member includes a first plate side and a second plate side, the first plate side includes a first magnetic member mounted thereto, and the second plate side includes a second magnetic member mounted to the second plate side, wherein the first and second magnetic members are coaxially aligned relative to one another to permit securement of one of the magnetic members to an interior drum of an associated laundry device, and wherein the first magnetic member is defined by a predetermined first width, the second magnetic member is defined by a predetermined second width, and the plate member is defined by a predetermined plate width, and including a threaded fastener defined by a predetermined length substantially equally to the first width, the second width, and the plate width, and wherein the first magnetic member includes a first bore, the second magnetic member includes a threaded second bore, wherein the threaded fastener is positioned through the first bore, the plate member and the second bore securement of the magnetic members to the plate member, and wherein the magnetic members are of a cylindrical configuration to minimize engagement with laundry garments during a laundry procedure.

* * * * *